US010479551B2

(12) United States Patent
Frank

(10) Patent No.: US 10,479,551 B2
(45) **Date of Patent: *Nov. 19, 2019**

(54) END CLOSURE WITH DOUBLE ANTI-MISSILE SCORE

(71) Applicant: Ball Corporation, Broomfield, CO (US)

(72) Inventor: Dennis K. Frank, Lafayette, CO (US)

(73) Assignee: BALL CORPORATION, Broomfield, CO (US)

( * ) Notice: Subject to any disclaimer, the term of this patent is extended or adjusted under 35 U.S.C. 154(b) by 207 days.

This patent is subject to a terminal disclaimer.

(21) Appl. No.: 15/284,309

(22) Filed: Oct. 3, 2016

(65) Prior Publication Data

US 2017/0021962 A1 Jan. 26, 2017

Related U.S. Application Data

(60) Division of application No. 14/639,611, filed on Mar. 5, 2015, now Pat. No. 9,580,203, which is a (Continued)

(51) Int. Cl.
*B21D 51/38* (2006.01)
*B21D 19/12* (2006.01)
(Continued)

(52) U.S. Cl.
CPC ..... *B65D 17/4011* (2018.01); *B21D 19/12* (2013.01); *B21D 35/002* (2013.01);
(Continued)

(58) Field of Classification Search
CPC ..... B21D 51/38; B21D 51/383; B21D 19/12; B65D 17/4011; B65D 17/4012; B65D 17/404; B65B 61/184
See application file for complete search history.

(56) References Cited

U.S. PATENT DOCUMENTS 5,375,729 A 12/1994 Schubert
5,555,992 A 9/1996 Sedgeley
(Continued)

FOREIGN PATENT DOCUMENTS

CA 2662199 3/2008
WO WO 1998/022355 5/1998
(Continued)

OTHER PUBLICATIONS

International Search Report and Written Opinion for International (PCT) Patent Application No. PCT/US2014/025869, dated Jul. 18, 2014 8 pages.
(Continued)

*Primary Examiner* — Teresa M Ekiert
(74) *Attorney, Agent, or Firm* — Sheridan Ross P.C.

(57) ABSTRACT

An end closure for food and beverage containers provides controlled opening characteristics to prevent the unintentional missiling of a tear panel. The end closure comprises a score line that defines a portion of the tear panel, and the end closure may comprise one or more anti-missile features that inhibit the propagation of a fracture down a score line, which reduces the likelihood that a tear panel will inadvertently detach from the end closure and injure the user or another.

20 Claims, 13 Drawing Sheets

Related U.S. Application Data continuation of application No. 14/209,055, filed on Mar. 13, 2014, now Pat. No. 9,033,175.

(60) Provisional application No. 61/800,373, filed on Mar. 15, 2013.

(51) Int. Cl.

| | |
|---|---|
| ***B21D 35/00*** | (2006.01) |
| ***B65D 17/28*** | (2006.01) |
| ***B65B 61/18*** | (2006.01) |

(52) U.S. Cl.

CPC ..... *B21D 51/383* (2013.01); *B65B 61/184* (2013.01); *B65D 2517/0013* (2013.01); *B65D 2517/0026* (2013.01); *B65D 2517/0028* (2013.01); *Y10T 29/49826* (2015.01)

(56) References Cited

U.S. PATENT DOCUMENTS

| | | | |
|---|---|---|---|
| 5,738,237 | A | 4/1998 | McEldowney |
| 5,875,911 | A | 3/1999 | McEldowney |
| 6,024,239 | A | 2/2000 | Turner et al. |
| 6,129,230 | A | 10/2000 | Turner et al. |
| 6,715,629 | B2 | 4/2004 | Hartman et al. |
| 6,761,281 | B2 | 7/2004 | Hartman |
| 6,889,862 | B2 | 5/2005 | Vaughan |
| 6,908,005 | B1 | 6/2005 | Strube et al. |
| 7,000,797 | B2 | 2/2006 | Forrest et al. |
| 7,926,675 | B2 | 4/2011 | Rieck et al. |
| 8,336,728 | B2 | 12/2012 | Forrest et al. |
| 9,033,175 | B2 | 5/2015 | Frank |
| 2001/0002671 | A1 | 6/2001 | Heinicke et al. |
| 2002/0113069 | A1 | 8/2002 | Forrest et al. |
| 2011/0297679 | A1 | 12/2011 | Gogola et al. |
| 2011/0303672 | A1 | 12/2011 | Fields et al. |
| 2012/0205378 | A1 | 8/2012 | Forrest |
| 2013/0126529 | A1 | 5/2013 | Nesling et al. |
| 2015/0175300 | A1 | 6/2015 | Frank |

FOREIGN PATENT DOCUMENTS

| | | |
|---|---|---|
| WO | WO 03/053800 | 7/2003 |
| WO | WO 2011/053776 | 5/2011 |

OTHER PUBLICATIONS

International Preliminary Report on Patentability for International (PCT) Patent Application No. PCT/US2014/025869, dated Sep. 24, 2015 7 pages.

Official Action for U.S. Appl. No. 14/209,055, dated Sep. 23, 2014 15 pages.

Notice of Allowance for U.S. Appl. No. 14/209,055, dated Jan. 23, 2015 9 pages.

Official Action for U.S. Appl. No. 14/639,611, dated Feb. 4, 2016 7 pages Restriction Requirement.

Official Action for U.S. Appl. No. 14/639,611, dated Jun. 9, 2016 7 pages.

Notice of Allowance for U.S. Appl. No. 14/639,611, dated Oct. 24, 2016 8 pages.

END CLOSURE WITH DOUBLE ANTI-MISSILE SCORE

CROSS REFERENCE TO RELATED APPLICATIONS

This Non-Provisional applications is a Divisional of U.S. patent application Ser. No. 14/639,611 filed Mar. 5, 2015, which is a Continuation of U.S. application Ser. No. 14/209,055 filed Mar. 13, 2014, which claims the benefit of priority from U.S. Provisional Patent Application No. 61/800,373 filed Mar. 15, 2013, the entire disclosures of which are hereby incorporated by reference in their entirety.

FIELD OF THE INVENTION

Embodiments of the present invention generally relate to containers and container end closures, specifically container end closures with controlled opening characteristics.

BACKGROUND OF THE INVENTION

Containers, and more specifically metallic beverage containers, generally have a neck on an upper portion of a container body that is adapted for interconnection to an end closure. The end closure is typically formed from a flat sheet of metallic material and generally includes a pull tab or other form of stay on tab ("SOT"). Beverage containers commonly store carbonated beverages, thus, both the container body and the end closure are required to withhold internal pressures up to 90 psi without catastrophic failure or permanent deformation. Further, the end closure must be manufactured, stacked, shipped, and sent to a filler prior to being seamed onto a container body filled with a carbonated beverage. Therefore, the container body and end closure must be designed to resist deformation and failure while utilizing thin metallic materials and allowing compact stacking during shipping and manufacturing.

Food and beverage containers with pull tabs or SOTs are generally known. Various SOTs and related features are disclosed, by way of example, in U.S. Pat. No. 7,926,675 to Rieck et al., the entire disclosure of which is hereby incorporated by reference in its entirety. Known devices typically contain a score and an anti-fracture score that defines a tear panel. A user may pivot the pull tab into the tear panel to dispense the contents of the container. Such an arrangement, particularly where can contents are placed under pressure, pose various complications and challenges with opening the container. Such complications include, but are not limited to, rapid score flexure or breakage, which may result in the tear panel disconnecting from the end closure and shooting outward from the end closure and thus becoming a "missile."

Previous attempts have been made to manufacture end closures with controlled opening characteristics. One such feature is a check slot, which is generally a portion of the score that is cut shallower than the rest of the score, or in other words, the check slot has a larger residual of material underneath the score. A check slot is disclosed in U.S. Patent Publication No. 2011/0303672 to Fields at al., the entire disclosure of which is hereby incorporated by reference in its entirety. The additional material underneath the check slot inhibits propagation of the fracture that occurs when a user pivots a pull tab into the tear panel. However, more score residual can make the end closure difficult to open, and a score with a non-uniform depth adds complexity to the manufacturing process of the end closure, and thus expense.

Other attempts to provide an end closure with a tear panel that will not detach and turn into a missile include an end closure with one anti-missile feature that is an indention or depression crossing the anti-fracture score but not crossing the main score and a check slot portion of the main score. However, each of these features require different tooling and machinery, and thus, manufacturing can be expensive.

Due to the numerous limitations associated with the prior art described above, the following disclosure describes an improved end closure that is adapted for interconnection to a container body and that employs anti-missile features, which eliminate the missiling effect of the tear panel without increasing the difficulty of opening the container.

SUMMARY OF THE INVENTION

These and other needs are addressed by the various embodiments and configurations of the present invention. This disclosure relates to novel systems, devices, and methods for providing a food and beverage end closure with anti-missile features. The novel end closure provided herein allows the user to open the end closure without the tear panel inadvertently detaching and thus becoming a missile, which may harm the user. Note that the term "score" may be used herein interchangeably with "score line" or sometimes "main score." Additionally, the term "anti-missile" may be used herein interchangeably with "anti-missile feature."

It is one aspect of the present invention to provide an end closure that controls the release of pressure from a container when a user opens said container. After the user pivots the pull tab into the tear panel (i.e., initially flexes the score), the score begins to fracture. Initially, the start of the fracture allows the interior pressure of the container to equalize with the atmospheric pressure. In some embodiments of the present invention, a double anti-missile feature slows down the propagation of the fracture along the score to prevent the tear panel from inadvertently detaching and becoming a missile.

It is another aspect of the present invention to provide an end closure that reduces or eliminates the need for a check slot. Containers store different contents at different pressures. For example, soda or pop is generally stored at a higher pressure than beer. Thus, some lower pressure containers do not require a check slot to control opening characteristics of the end closure. When the check slot is reduced or eliminated, the machinery and manufacturing methods used to create score lines on end closures may be standardized across containers with varying pressures, which reduces the cost of manufacturing.

It is an another aspect of the present invention to provide an end closure with anti-missile features in combination with a check slot to more robustly control the opening of a tear panel. The check slot portion of a score has a larger residual of material underneath the check slot, and an anti-missile feature disposed proximate to the check slot may inhibit propagation of a fracture along the score to an even greater degree. This combination may allow the end closure and the container to store beverages or contents at even greater pressures.

It is another aspect of the present invention to provide different opening characteristics of an end closure. To provide these characteristics, anti-missile features may be disposed in a variety of locations, orientations, shapes, and numbers. For example, anti-missile features positioned on either side of the score at the same location on the score may provide an abrupt slowdown in the propagation of the fracture down the score. In other embodiments, anti-missile features may be adjacent on the same side of the score but spaced far apart or set off of the score by a distance, which may produce a more gradual slowdown in the propagation of the fracture down the score. Further yet, in some embodiments combinations of anti-missile features can provide a series of opening effects such as a gradual slow down in the propagation of the fracture down the score followed by an abrupt slow down. The various opening characteristics provided herein not only improve the safety of the end closure but also provide also provide the user with a comfortable opening motion that is not overly cumbersome or difficult.

It is yet another aspect of the present invention to provide controllable opening features for a wide range of food and beverage containers including, but not limited to, pressurized beverage containers with SOTs secured by a rivet, food containers with tear away lids, and full panel easy-open end tabs. The present invention may enjoy implementation in these containers because end closures and containers are designed to be as thin as reasonably possible to save on material costs and to improve openability of the container. In addition, although some embodiments of the present invention generally relate to end closures and containers made from metal, other embodiments of the present invention and features described herein may be implemented using plastic or any other type of material commonly used in end closures and containers.

It is another aspect of the present invention to provide an end closure with anti-missile features that is manufactured with conventional manufacturing equipment. In some embodiments, the anti-missile feature is formed using an insert, a knife, forms, or coins, to push the metal material toward the score. In a preferred embodiment, the anti-missile feature is formed using an insert to create an indentation in the end closure and move metal toward the main score. The insert may comprise shaped features that protrude from the insert and correspond to anti-missile features described herein. Further, devices and methods of the present disclosure contemplate forming an anti-missile feature on an end closure at various stages of manufacture. For example, an anti-missile feature may be formed on an end panel before, during, or after formation of features such as debossed features, rivets, frangible score lines defining opening areas, etc. In preferred embodiments, the anti-missile features are added after the score or scores are created on the end panel.

It is another aspect of the present invention to provide an end closure with anti-missile features that do not decrease tab access or increase the difficulty in opening the end closure. Embodiments of the present disclosure allow the stacking and conveying of multiple end closures during production and shipping because these embodiments do not affect the position of the tab or other features of the end closure.

Various embodiments of the present invention provide an end closure with anti-missile features in a variety of locations. In some embodiments, the anti-missile features are located proximate a rivet, a score loop, a content side of the end closure, a public side of the end closure, and/or over an anti-fracture score. Further, the anti-missile feature may be positioned at a number of distances from the score line. In a preferred embodiment, the anti-missile feature does not cross the main score, which reduces pop and push numbers, thereby making the end closure easier to open. Locating anti-missile features in these locations, or combination of locations, provides a variety of different opening characteristics of the end closure.

In a similar vein, in some embodiments of the present invention, anti-missile features are disposed in a variety of orientations. Some anti-missile features have a longitudinal axis, which may be substantially perpendicular to the main score. In other embodiments the anti-missile feature's longitudinal axis may be disposed substantially parallel to the score to provide a deformation or distortion to a greater portion of the score. In yet further embodiments the anti-missile feature is oriented an angle relative to the score, and in some embodiments a bottom surface of the anti-missile feature does not lie in a common plane with the end closure. These various orientations, and others, provide varying opening characteristics of the end closure.

In some embodiments of the present invention, anti-missile features have various shapes to provide different opening characteristics of the end closure. Shapes of anti-missile features when viewed from a top plan view include, but are not limited to, a rectangle, an ovoid, any polygon such as a hexagon, a trapezium, and a "U" shape. When viewed from a cross-sectional perspective, the anti-missile feature also has a variety of shapes and orientations. The bottom surface of the anti-missile feature may be flat, curved, or asymmetrical with chamfered or radiused edges. Further yet, the anti-missile feature may come in a variety of sizes as well. The physical characteristics of the anti-missile feature help determine the deformation or distortion in the material of the main score, which provides different opening characteristics of the end closure.

In various embodiments of the present invention, an end closure comprises a double anti-missile feature. In one embodiment, the end closure comprises two anti-missile features that are the same size and angle. These anti-missile features may be disposed proximate the rivet, proximate the main score, and over the anti-fracture score. The double anti-missile feature provides a deformation or distortion of the metal of the main score at two locations along the score and another deformation or distortion of the main score between the two anti-missile features. This double anti-missile feature slows the opening of the tear panel in this section of the main score.

One embodiment of the present invention is a metallic end closure with controlled opening characteristics comprising a peripheral curl which is adapted for interconnection to a neck of a container body; a central panel; a countersink positioned between the peripheral curl and the central panel; a pull tab having a nose end and a tail end, wherein the pull tab is operably interconnected to the central panel; a first score line in the central panel which defines a tear panel; and at least one anti-missile feature positioned proximate to the first score line which deforms at least a portion of the first score line to affect the rate at which the tear panel opens along the first score line when a user pivots the nose end of the pull tab into the tear panel.

Another embodiment of the present invention is a method of forming a metallic end closure with an anti-missile feature comprising providing a blank metallic material; forming an end closure comprising a peripheral curl, a central panel, and a countersink positioned there between; forming a first score line on the central panel, wherein the first score line substantially defines a tear panel; providing an insert tool with at least one shaped feature disposed on a distal end of the insert tool; pressing the insert tool into at least one of the central panel and the tear panel such that the at least one shaped feature contacts the at least one of the central panel and the tear panel at a location proximate the first score line, wherein the at least one shaped feature creates at least one anti-missile feature in the end closure;

and interconnecting a pull tab to the central panel of the end closure, wherein a nose of the pull tab is positioned over the tear panel.

Yet another embodiment of the present invention is a metallic end closure with controlled opening characteristics comprising a peripheral curl which is adapted for interconnection to a neck of a container body; a central panel having a rivet disposed in a central location on a public side of the central panel; a countersink positioned between the peripheral curl and the central panel; a pull tab having a nose end and a tail end, wherein the pull tab is operably interconnected to the central panel; a first score line on the central panel defining a tear panel; a second score line on the tear panel oriented substantially parallel to the first score line, wherein the second score line is shallower than the first score line; and a first anti-missile feature and a second anti-missile feature, wherein the first and second anti-missile features are disposed over the second score line, proximate the first score line, and proximate a rivet which interconnects the pull tab to the central panel, wherein the first and second anti-missile features deform at least a portion of the first score line to inhibit propagation of a fracture along the first score line when a user engages the pull tab and forces the nose end into the tear panel.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Furthermore, the Summary of the Invention is neither intended nor should it be construed as being representative of the full extent and scope of the present invention. The present invention is set forth in various levels of detail in the Summary of the Invention, as well as in the attached drawings, the Detailed Description of the invention, and the Claims. No limitation as to the scope of the present invention is intended to either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

Those of skill in the art will recognize that the following description is merely illustrative of the principles of the present invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

Figure 1:
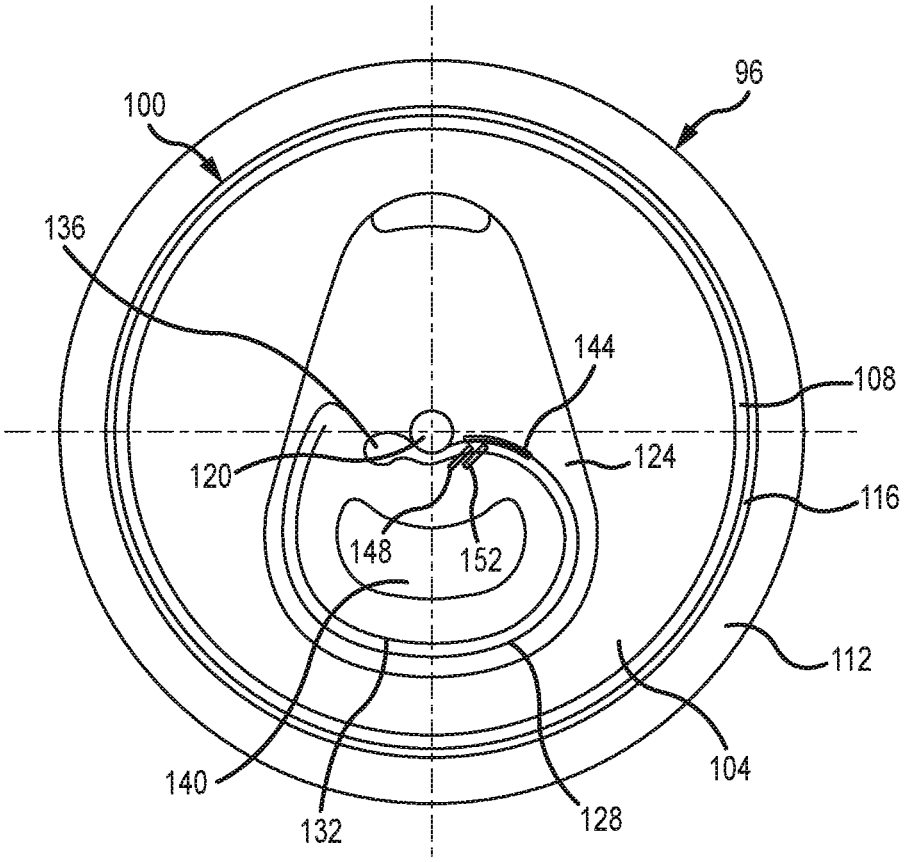
FIG. 1 is a top plan view of one embodiment of an end closure with anti-missile features.

To assist in the understanding of the embodiments of the present invention the following list of components and associated numbering found in the drawings is provided herein:

| Number | Component |
|---|---|
| 96 | Container Body |
| 100 | End Closure |
| 104 | Central Panel |
| 108 | Panel Radius |
| 112 | Peripheral Curl |
| 116 | Countersink |
| 120 | Rivet |
| 124 | Deboss Area |
| 128 | Main Score |
| 130 | Main Score Depth |
| 132 | Anti-Fracture Score |
| 134 | Anti-Fracture Score Depth |
| 136 | Score Loop |
| 140 | Pour Opening |
| 144 | Check Slot |
| 145 | First Check Slot End |
| 146 | Second Check Slot End |
| 148 | First Anti-Missile |
| 149 | First Anti-Missile Length |
| 150 | Missile-Fracture Intersection |
| 151 | First Anti-Missile Depth |
| 152 | Second Anti-Missile |
| 156 | Main Score Residual |
| 160 | Anti-Fracture Score Residual |
| 200 | Insert Tool |
| 204 | Body |
| 208 | First End |
| 212 | Second End |

-continued

| Number | Component |
|---|---|
| 216 | Flange |
| 220 | First Shaped Feature |
| 224 | Second Shaped Feature |
| 228 | Body Outer Diameter |
| 232 | Flange Outer Diameter |
| 236 | Flat Side Dimension |
| 238 | Shaped Feature Width |
| 240 | First Horizontal Offset |
| 244 | Second Horizontal Offset |
| 248 | Overall Length |
| 252 | Flange Length |
| 256 | Shaped Feature Length |
| 260 | First Body Radius |
| 264 | Second Body Radius |
| 268 | Shaped Feature Height |
| 272 | Angle |
| 276 | First Transition |
| 280 | Second Transition |
| 284 | First Centerline |
| 288 | Second Centerline |
| 292 | First Transition Distance |
| 296 | Second Transition Distance |

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

FIG. 1 shows a top plan view of the public side of an end closure 100 which is interconnected to the neck of container body 96. The end closure 100 in this embodiment generally comprises a central panel 104 that represents the central area of the end closure 100 in FIG. 1. A panel radius 108 defines the outer edge of the central panel 104. Moving outward from the panel radius 108 is a countersink 116 that leads from the central panel 104 to a chuckwall, which is interconnected to peripheral curl 112, and the peripheral curl 112 allows for interconnection to the container body 96. The central panel 104, the panel radius 108, the countersink 116, the chuckwall, and the peripheral curl 112 are generally circular in shape as depicted in FIG. 1. One skilled in the art will appreciate that any one of these features may have general modifications in shape or dimensions without deviating from the scope of the invention.

Also shown in FIG. 1 are two lines that pass through the center of a rivet 120, wherein the two lines may be used to reference the location of other features disposed on the end closure 100. One line passes vertically through the rivet 120, and one line passes horizontally through the rivet 120. These lines provide reference to planes that pass through the longitudinal axis of the container 96. In this embodiment, the rivet 120 is centered on the end closure 100, but in other embodiments, the rivet 120 may be off center and the reference lines will not necessarily partition the enclosure 100 into halves.

The rivet 120 provides a location for a pull tab (not shown) to be disposed. A user may engage the rear portion of the pull tab to provide a force on the nose portion to a tear panel defined by a main score 128. As the user continues to engage and pivot the pull tab, the main score 128 fractures and the tear panel is disposed into the container 96 to define a pour opening 140. In FIG. 1, the tear panel is located proximate the rivet 120 and is defined by two score lines. The outer score line is the main score 128, and the inner score line is the anti-fracture score 132. Typically, the anti-fracture score 132 has a shallower depth than the main score 128. In other words, the anti-fracture score 132 has a larger score residual, or larger amount of material underneath the score, than the main score 128. The anti-fracture score 132 is located proximate to the main score 128 to relieve stress areas around the main score 132 and prevent accidental opening of the main score 128.

The two score lines 128, 132 may join together at a score loop 136, which is located proximate to the rivet 120. In the embodiment depicted in FIG. 1, the score loop 136 is located to the lower left of the rivet 120, and the score loop 136 is where the end closure 100 begins to fracture as a user engages the pull tab. As the user continues to engage and pivot the pull tab, the fracture propagates down the main score 128, defining the tear panel. As the main score 128 continues to fracture around the perimeter of the tear panel, the main score 128 may simply terminate at a location proximate to the score loop 136 such that a small portion of the end closure 100 does not fracture, and thus the tear panel that passes through the pour opening 140 remains attached to the end closure 100 via a hinge. One skilled in the art will appreciate a variety of configurations of the terminus of the main score 128 including, but not limited to, a second score loop.

In the embodiment shown in FIG. 1, the rivet 120, the score lines 128, 132, and the pour opening 140 are disposed on a deboss area 124, which is an area of the central panel 104 that is slightly depressed or lower than the rest of the central panel 104. The deboss area 124 aids in the prevention of interference with the pull tab during production, storage, or stacking of the containers 96, where such interference may lead to accidental opening of the container 96. One skilled in the art will appreciate a deboss area 124 of varying depths, sizes, shapes, and locations, or end closure which are void of a deboss area 124.

As mentioned above, complications can arise during opening of the end closure 100 such as rapid fracture of the main score 128 that results in the tear panel becoming a missile or inadvertently detached. One feature that aids in mitigation of this problem is the check slot 144. The check slot 144 in FIG. 1 is located on the main score 128 on the opposite side of the rivet 120 from the score loop 136. Typically, the check slot 144 is cut to a shallower depth than the main score 128. In other words, the check slot 144 has a larger score residual. The purpose of the check slot 144 is to inhibit propagation of the fracture along the main score 128. The fracture begins in the score loop 136, then travels to the check slot 144 where the fracture is temporarily stopped or slowed down. This configuration allows the pressure inside the container 96 to equalize with the pressure of the atmosphere before the fracture continues to propagate past the check slot 144. One skilled in the art will appreciate check slots 144 of varying depths, lengths, and locations that may prove advantageous.

Also disposed on the central panel 104 are a first anti-missile feature 148 and a second anti-missile feature 152. The anti-missile features 148, 152 "push" material of the central panel towards the main score 128, which deforms a portion of the main score 128. In some embodiments this deformation is the pinching together of the two sides of the main score 128. When the two sides of the main score 128 are pinched, the propagation of the fracture is inhibited, temporarily stopped, or otherwise impeded. In some embodiments, the anti-missile features 148, 152 allow for the reduction in size of the check slot 144, and in some embodiments the anti-missile features 148, 152 allow for the complete elimination of the check slot 144.

Figure 2:
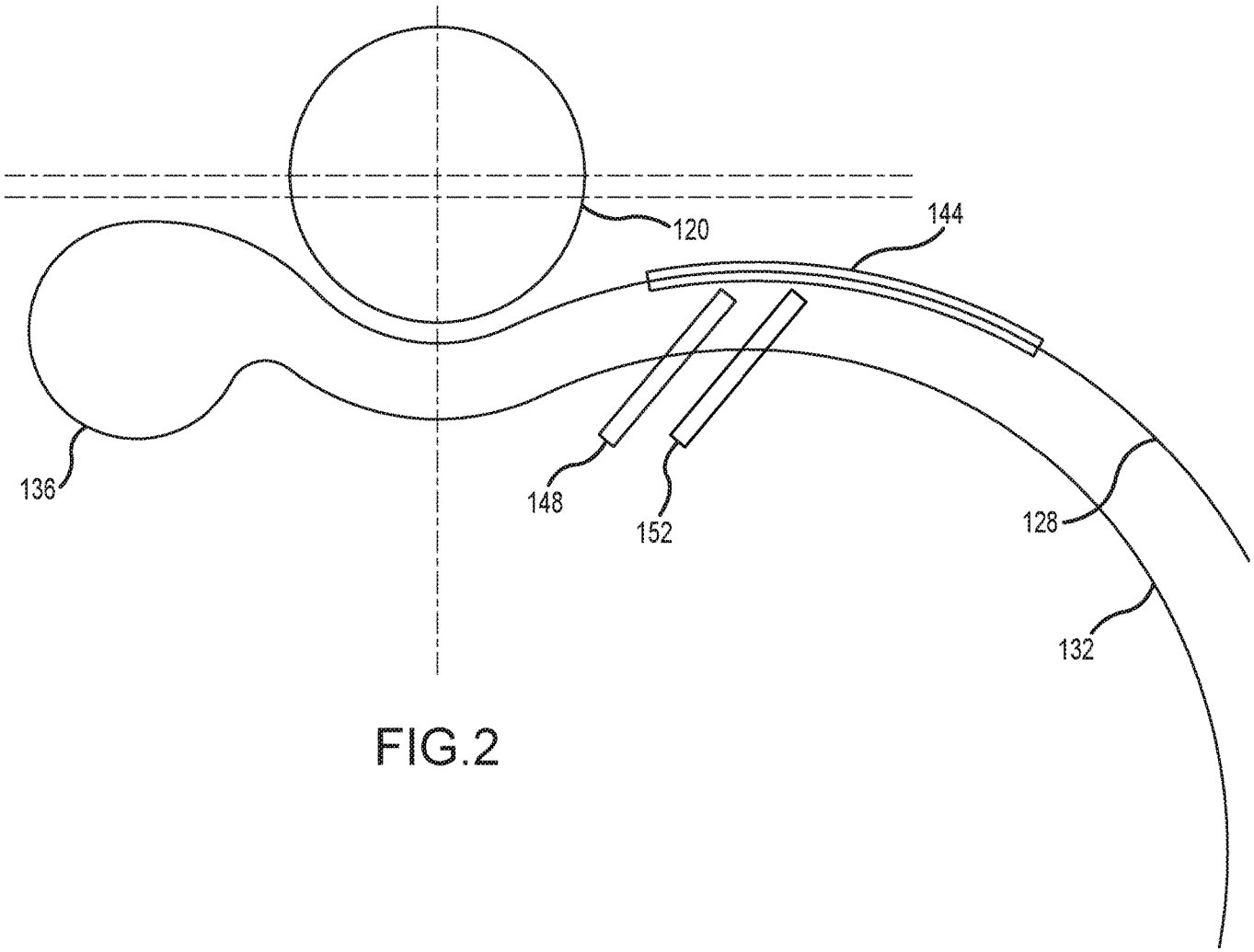
FIG. 2 is an enlarged top plan view of the anti-missile features shown in FIG. 1.

FIG. 2 depicts a top plan view of the end closure 100 shown in FIG. 1, and wherein the anti-missile features 148, 152 are enlarged for clarity. In this embodiment, the anti-missile features 148, 152 are both oriented at an angle of approximately 45 degrees from a horizontal plane. The second anti-missile feature 152 is offset from the first anti-missile feature 148 by approximately 0.026 inches in the horizontal direction, and approximately 0.030 inches in the vertical direction. The anti-missile features 148, 152 are disposed proximate the check slot 144 portion of the main score 128. The inclusion of the second anti-missile feature 152 provides a second location of deformation or distortion of the material of the main score 128. Further, there is deformation or distortion of the material along the main score 128 between the first anti-missile feature 148 and the second anti-missile feature 152.

One skilled in the art will appreciate various angles and configurations of anti-missile features 148, 152 that provide various benefits. In some embodiments, anti-missile features 148, 152 are disposed on either side of the main score 128 at a common point on the main score 128. If the anti-missile features 148, 152 are oriented substantially perpendicular to the main score 128, then the main score 128 is deformed from both sides instead of only one side. This anti-missile configuration results in a more thorough deformation of the end closure 100 and the main score 128. In some embodiments, the deformation is a more complete and robust deformation or distortion of the two sides of the main score 128. Therefore, as the fracture propagates down the main score 128 the fracture will more abruptly slow down before resuming down the main score 128. This produces a different feel for the user and a different venting response for the end closure 100, all while reducing the risk of the tear panel turning into a missile.

In a further embodiment, the anti-missile features are substantially parallel to the main score 128. This exposes a greater length of the main score 128 to the deformations in the end closure 100 produced by the anti-missile features 148, 152. In this parallel orientation, anti-missile features 148, 152 may be disposed in series along the main score 128. This configuration will produce a deformation that has a less pronounced effect on the main score 128 but affects a greater length of the score 128. Therefore, this configuration will provide a smoother feel to the user as he or she opens the container and will provide a different venting response for the end closure 100, again, all while reducing the risk of the tear panel turning into a projectile or missile.

In other embodiments, two anti-missile features 148, 152 are substantially parallel with one feature disposed on each side of the main score 128 at a common location on the main score 128. This configuration will produce a more robust deformation of the main score 128 since the anti-missile features 148, 152 are disposed on either side, and the deformation is along a length of the main score 128. As mentioned above, this provides a different feel to the user and a different venting response.

Further, the anti-missile features 148, 152 need not be disposed proximate to a common point on the main score 128. Other embodiments of the present invention have anti-missile features 148, 152 that are disposed on either side of the main score 128 but at different locations along the main score 128. Depending on the offset between the anti-missile features 148, 152, the deformation of the end closure 100 and the resulting effect may be a twisting or similar distortion of the main score 128, which provides yet another feel for the user and a difference in performance of the end closure 100.

Embodiments of the present invention may comprise any number of anti-missile features. Some embodiments of the present invention utilize one anti-missile feature, while other embodiments utilize two or more anti-missile features. In the embodiment where the two anti-missile features 148, 152 are disposed on either side of the main score 128, substantially perpendicular to the main score 128, and located at a common point on the main score 128; a series of these pairs of anti-missile features may be disposed along the length of the main score 128 to provide a series of abrupt slow-downs in the propagation of the fracture along the main score 128. Alternatively, some embodiments may have asymmetric combinations of anti-missile features 148, 152 wherein the anti-missile features 148, 152 are disposed on either side of the main score 128 but never at a common location on the main score 128. This configuration of the main score 128 may provide a deformation that is a twisting or distortion of the main score 128 that produces a particular effect on the propagation of the main score 128.

In some embodiments, the shape of the main score 128 drives the location, shape, orientation, and number of anti-missile features 148, 152. When viewed in cross-section, the main score 128 may be shaped as a "V" or a "U". Further, the main score 128 may have a bottom surface that is substantially perpendicular to the two side walls of the main score 128. The main score 128 may have any number of profiles that are commonly known in the art. The profiles that have a large distance between the two sides may necessitate a more aggressive or robust anti-missile 148, 152 configuration. Whereas a narrow "V" with relatively close sides may require a less aggressive or robust anti-missile 148, 152 configuration.

Figure 3:
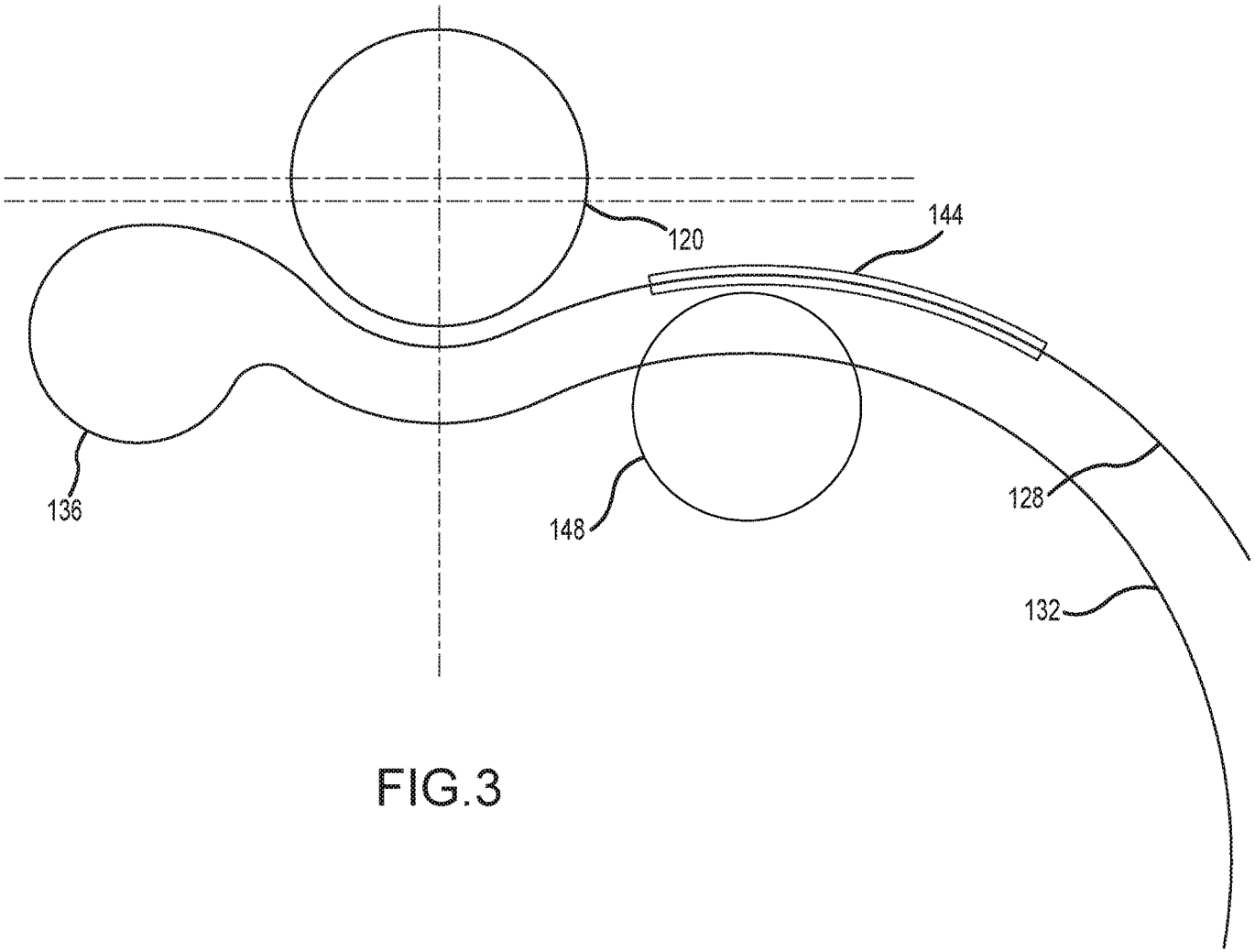
FIG. 3 is a top plan view of an alternative embodiment of an end closure with a dimple-shaped anti-missile feature.

FIGS. 3-6E show examples of the various shapes of the anti-missile features 148, 152. These are only exemplary in nature and are not meant to be limiting. The various shapes provide different deformations or distortions to the main score 128, and thus varying opening characteristics of the end closure 100. FIG. 3 shows a top plan view of an end closure 100 where the first anti-missile feature 148 is circular or dimple-shaped. In this embodiment, the first anti-missile feature 148 pushes material radially from the center of the first anti-missile feature 148. This allows for a greater length of the main score 128 to be deformed or distorted.

Figure 4:
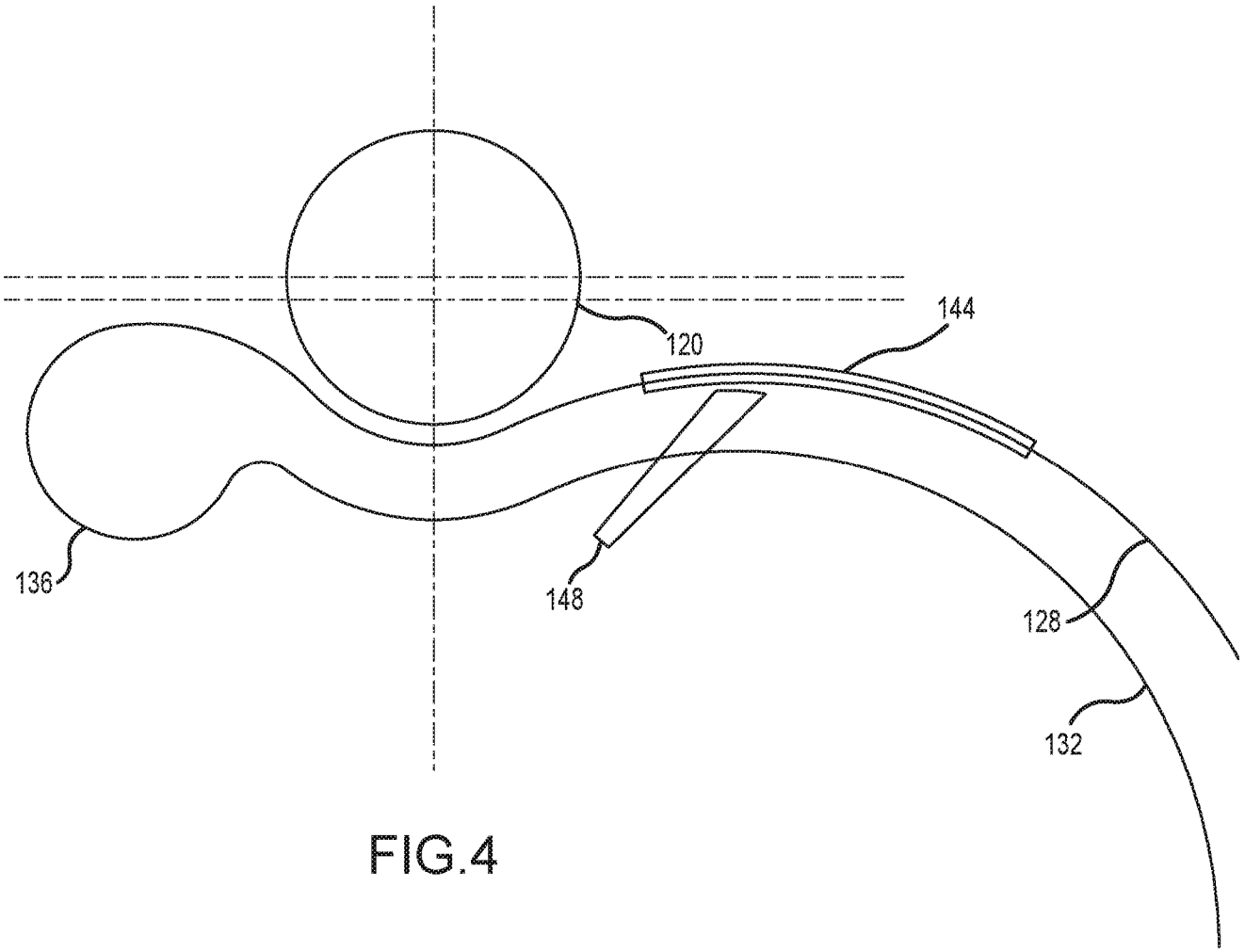
FIG. 4 is a top plan view of an alternative embodiment of an end closure with a trapezium-shaped anti-missile feature.

FIG. 4 shows a top plan view of an end closure 100 where the first anti-missile feature 148 is trapezium-shaped. In other words, the first anti-missile feature 148 has four sides, and no two sides are parallel. The side of the first anti-missile feature 148 proximate the main score 128 is substantially parallel to the main score 128. This allows the first anti-missile feature 148 to deform or distort as much of the main score 128 as possible while retaining a similar angle from horizontal as the first anti-missile feature 148 depicted in FIG. 2. Further, the trapezium shape of the first anti-missile feature 148 allows for a greater area of the central panel 104 to be "pushed" toward the main score 128, which provides a more through deformation or distortion of the main score 128.

Figure 5:
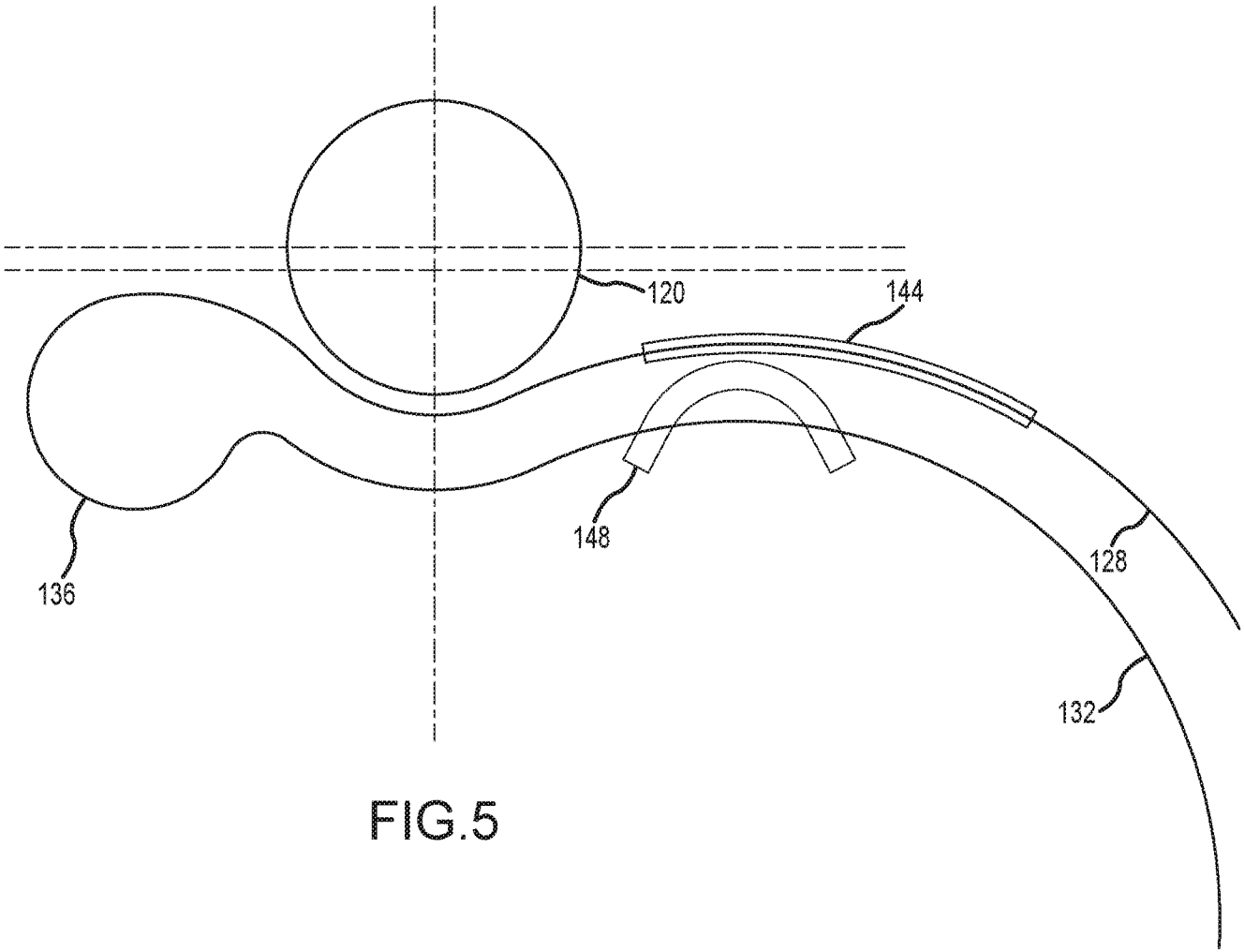
FIG. 5 is a top plan view of an alternative embodiment of an end closure with a U-shaped anti-missile feature.

FIG. 5 shows a top plan view of an end closure 100 where the first anti-missile feature 148 has an arcuate shape and wherein the ends of the legs of the "U" are pointing away from the main score 128. This orientation of the "U" allows a greater portion of the first anti-missile feature 148 to be located proximate the main score 128. In turn, a greater portion of the main score 128 is deformed or distorted, and the propagation of the fracture during opening of the end closure 100 is slowed down or temporarily stopped. The two legs of the first anti-missile feature 148 in FIG. 5 are not substantially parallel. Rather, the two legs are offset at an angle from a plane that traverses the anti-missile feature 148 in the longitudinal direction. One skilled in the art will appreciate other embodiments of the present invention that have an offset angle between approximately 180 degrees and approximately −15 degrees.

Figure 6A:
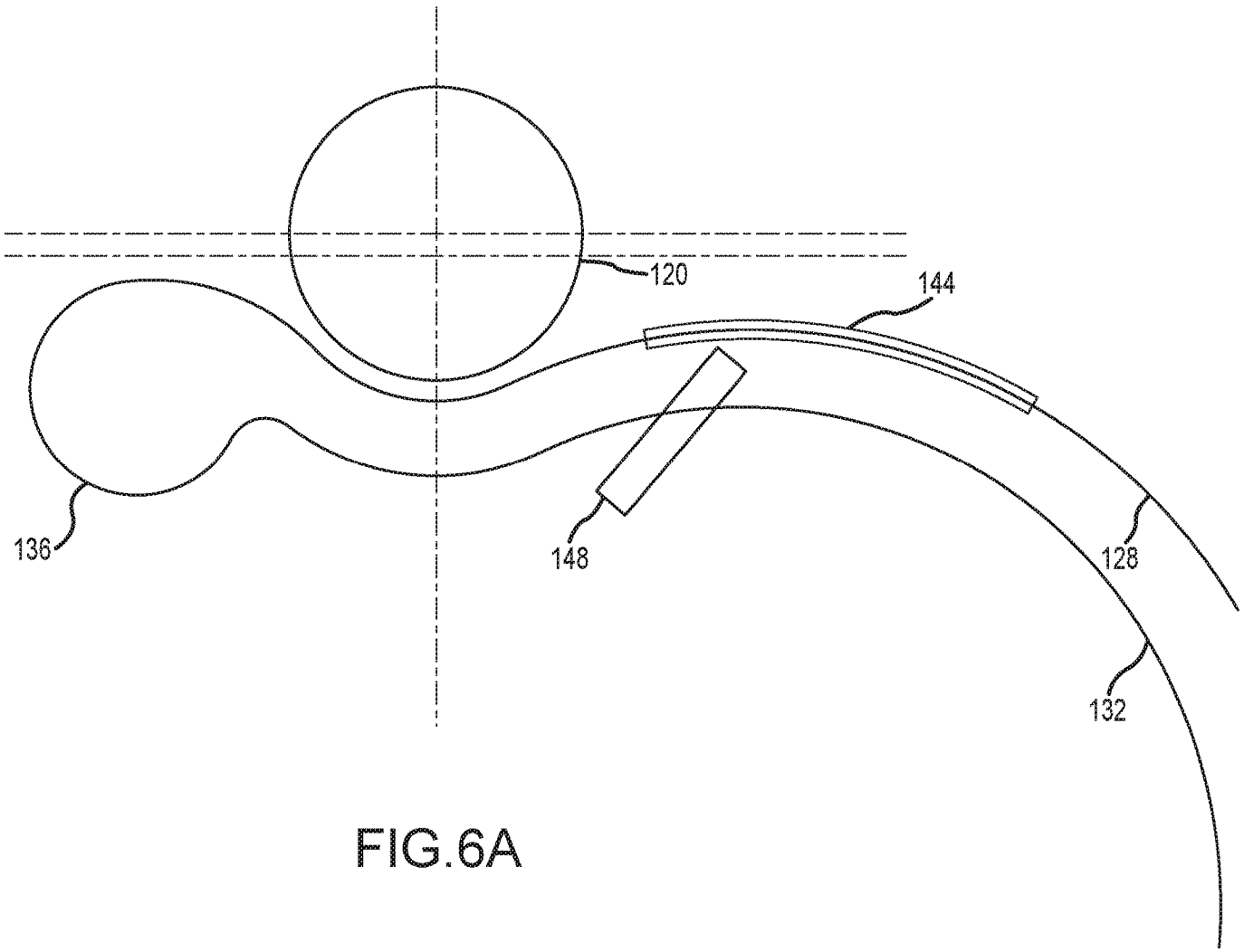
FIG. 6A is a top plan view of an alternative embodiment of an end closure with a single, wide anti-missile feature.

FIG. 6A shows a top plan view of an end closure 100 that has a relatively wide first anti-missile feature 148. In this embodiment, the width of the first anti-missile feature 148 is approximately twice the width of the first anti-missile feature 148 depicted in FIG. 2. The double width means there is twice as much area of the central panel 104 that is being "pushed." This allows for a more thorough deformation or distortion of the main score 128, which results in a slow down or temporary stop in the propagation of the fracture of the main score 128.

Figure 6B:
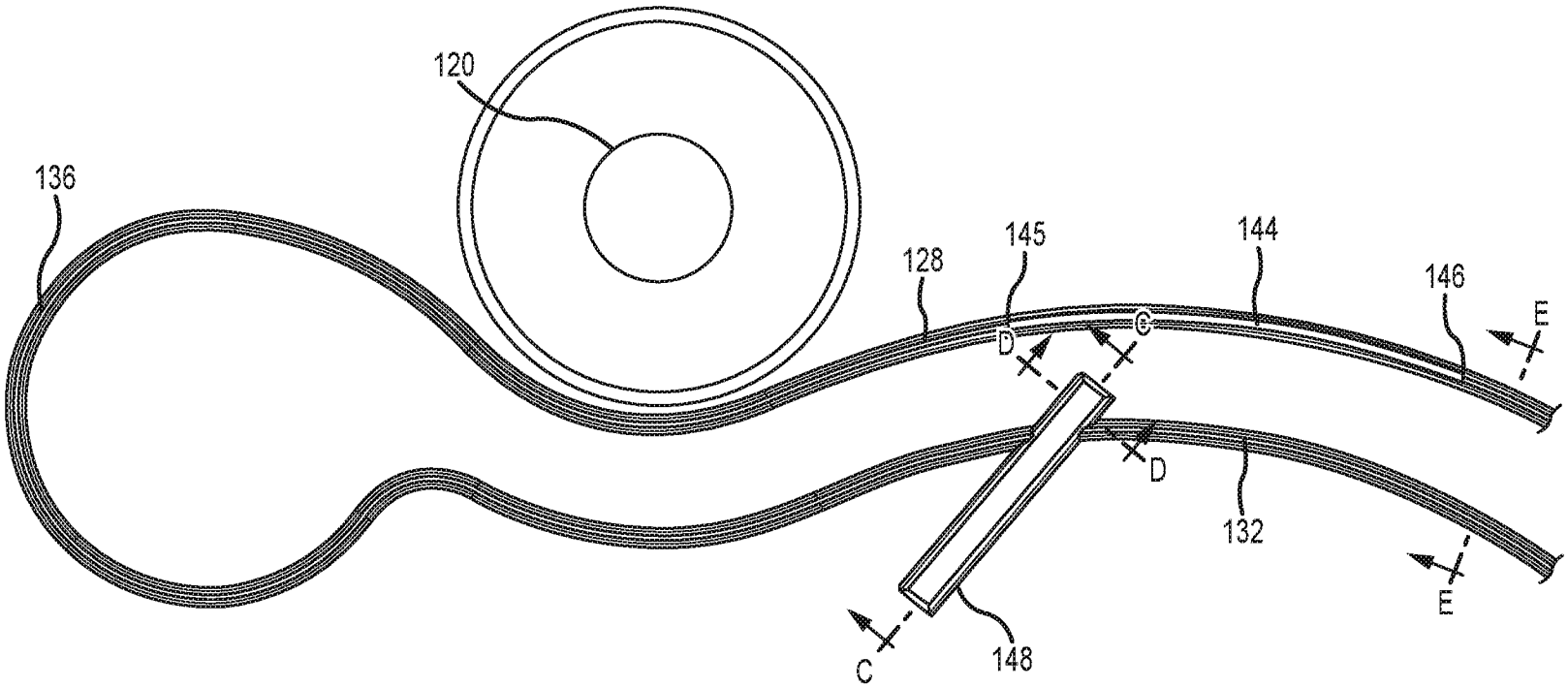
FIG. 6B is another top plan view of the embodiment shown in FIG. 6A where reference lines "C", "D", and "E" are visible.

FIG. 6B shows an enlarged plan view of the end closure 100 of FIG. 6A including a first check slot end 145 that is disposed proximate the rivet 120 and a second check slot end 146 that is disposed on the end of the check slot 144 opposite the first check slot end 145. Also shown in FIG. 6B is reference line "C-C", reference line "D-D", and reference line "E-E". Reference line "C-C" traverses the longitudinal length of the first anti-missile feature 148 and is perpendicular to the central panel 104. reference line "D-D" traverses the lateral dimension of the first anti-missile feature 148 at the end of the first anti-missile feature 148 that is proximate the anti-fracture score 132. Reference line "D-D" is also oriented perpendicular to the central panel 104. Reference line "E-E" is substantially perpendicular to the main score 128 and the anti-fracture score 132, and the reference line "E-E" is oriented perpendicular to the central panel 104.

Figure 6C:
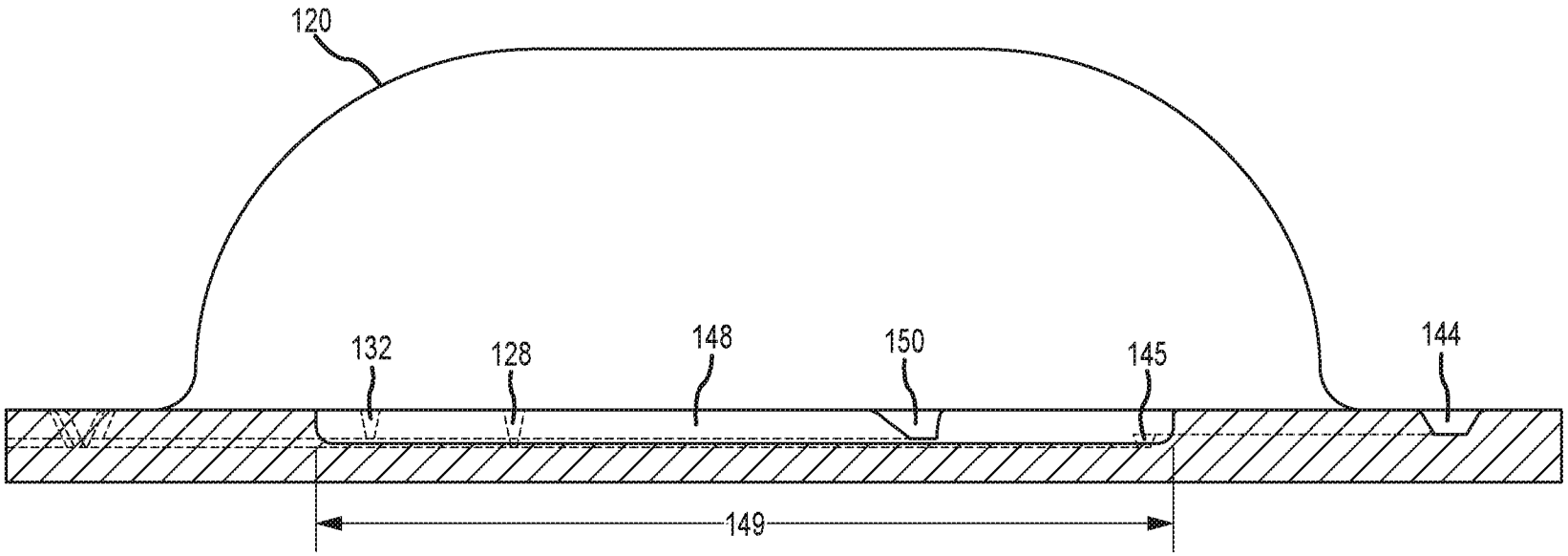
FIG. 6C is a cross-sectional elevation view of the embodiment shown in FIG. 6B taken at line "C-C"

FIG. 6C shows a cross-sectional view of the end closure 100 at reference line "C-C". In the background of this view is the rivet 120. The anti-fracture score 132 intersects the first anti-missile feature 148 at the missile-fracture intersection 150, and the anti-fracture score 132 continues to travel to the left in FIG. 6C as shown by a dashed line. Similarly the check slot 144 is shown on the right side of FIG. 6C. Traveling leftward, the check slot 144 terminates at the first check slot end 145. The main score 128 continues to travel to the left of the check slot 144 in FIG. 6C as shown by a dashed line.

Finally, the first anti-missile feature 148 is shown in FIG. 6C, which is disposed across the anti-fracture score 132 but not the main score 128. The first anti-missile feature 148 has a first anti-missile feature length 149, which is 0.1 inches in this embodiment.

Figure 6D:
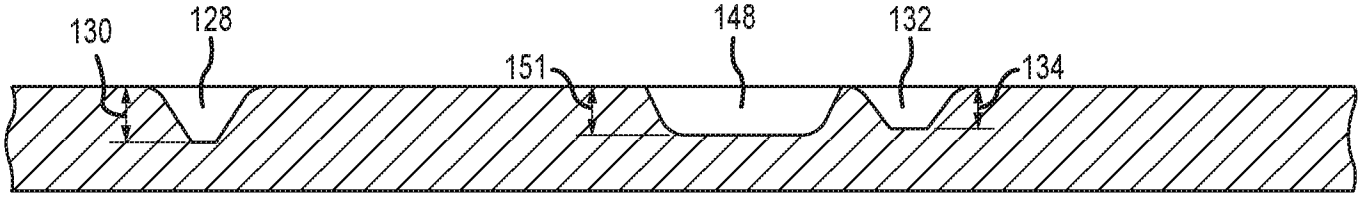
FIG. 6D is a cross-sectional elevation view of the embodiment shown in FIG. 6B taken at line "D-D"

FIG. 6D shows a cross-sectional view of the end closure 100 at reference line "D-D". The main score 128 is disposed on the left side of FIG. 6D, and the main score 128 has a main score depth 130. In this embodiment, the main score depth 130 is approximately 0.0045 inches. Next, FIG. 6D shows a view down the longitudinal direction of the first anti-missile feature 148. The first anti-missile feature 148 has a first anti-missile depth 151. In preferred embodiments, the first anti-missile depth 151 is between approximately 0.0070 inches and 0.0010 inches. In more preferred embodiments, the first anti-missile depth 151 is between approximately 0.0030 inches and 0.0050 inches. In a most preferred embodiment, the first anti-missile feature depth 151 is approximately 0.0040 inches. Therefore, the anti-missile features, such as the first anti-missile feature 148, can have a shallower depth than the main score 128. Lastly, the anti-fracture score 132 is disposed to the right of the first anti-missile feature 148 in FIG. 6. The anti-fracture score 132 has an anti-fracture score depth 134, which is approximately 0.0035 inches in this embodiment of the present invention.

Figure 6E:
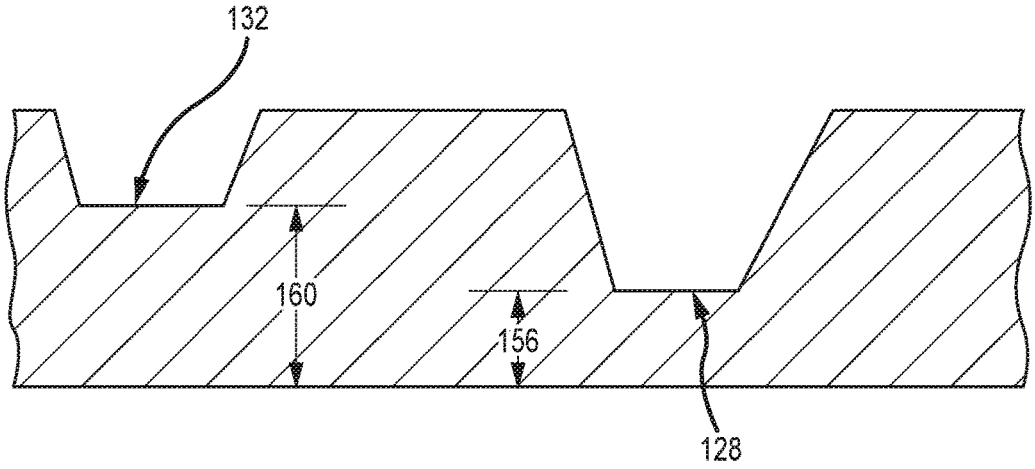
FIG. 6E is a cross-sectional elevation view of the embodiment shown in FIG. 6B taken at line "E-E"

FIG. 6E shows a cross-sectional view of the main score 128 and the anti-fracture score 132 at reference line "E-E". From this view, the anti-fracture score 132 is located on the left and the main score 128 is located on the right. The top side of the end closure is the public side of the container and the bottom side of the end closure is the content side of the container. An anti-fracture score residual 160 is measured from the bottom of the end closure to the bottom of the anti-fracture score 132. Likewise, a main score residual 156 is measured from the bottom of the end closure to the bottom of the main score 128. Thus, while the anti-fracture score 132 has a shallower depth than the main score 128, the anti-fracture score residual 160 is larger than the main score residual 156 by approximately 0.002 inches.

Figure 7:
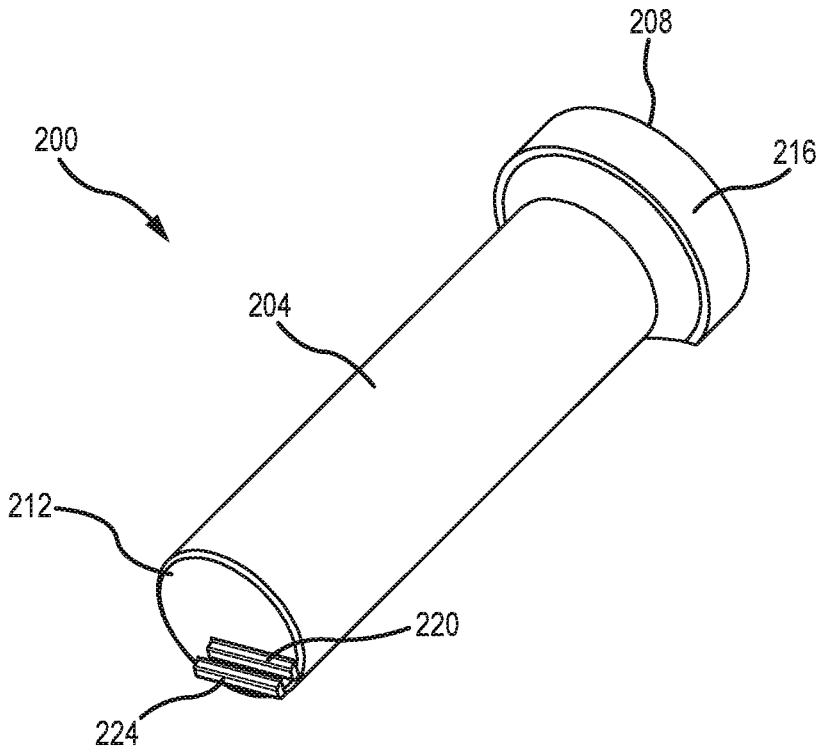
FIG. 7 is an isometric view of an embodiment of an insert tool.

FIG. 7 shows an isometric front perspective view of an insert tool 200 used to make an anti-missile feature. In one embodiment, the insert tool 200 has a cylinder-shaped body 204 with a first end 208 and a second end 212. The first end 208 comprises a flange 216 such that the insert tool 200 may be secured during the manufacturing process of the anti-missile features. The flange 216 in this embodiment is shaped like a flat cylinder. The second end 212 of the insert tool 200 comprises a first shaped feature 220 and a second shaped feature 224. The shaped features 220, 224 are what form the anti-missile features, and the shaped feature 220, 224 may be configured to generate any anti-missile features described elsewhere herein.

Figure 8:
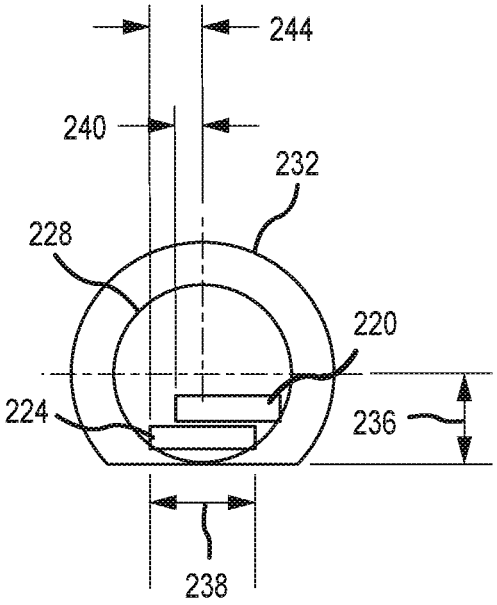
FIG. 8 is front elevation view of the insert tool of FIG. 7.

FIG. 8 shows a front elevation view of the insert tool 200 where the working end of the insert tool is visible. In this embodiment, an outer diameter 228 of the body 204 is between approximately 0.1700 and 0.1698 inches, with a position tolerance of approximately 0.0004 inches. An outer diameter 232 of the flange 216 is approximately 0.25 inches with a position tolerance of approximately 0.1 inches. Further, the outer diameter 232 of the flange 216 has a flat side. The flat side dimension 236 can be referenced from a central plane of the flange 216. In this embodiment, the flat side dimension 236 is between approximately 0.0853 and 0.0855 inches.

FIG. 8 also shows the two shaped features 220, 224, which are substantially the same size in this embodiment. The shaped features 220, 224 have a rectangular shape in FIG. 8, where the longer, width dimension 238 of the shaped features 220, 224 is between approximately 0.101 and 0.099 inches. Further, this longer dimension is substantially parallel with the flat side of the flange 216.

The shaped features' 220, 224 horizontal position, as shown in FIG. 8, can be expressed in terms of offset from a vertical plane through the center of the body 204. The first horizontal offset 240 is measured from the left edge of the first shaped feature 220 to the vertical plane. In this embodiment, the first horizontal offset 240 is between approximately 0.027 and 0.025 inches. The second horizontal offset 244 is measured from the left edge of the second shaped feature 224 to the vertical plane. In this embodiment, the second horizontal offset 244 is between approximately 0.051 and 0.049 inches.

Figure 9:
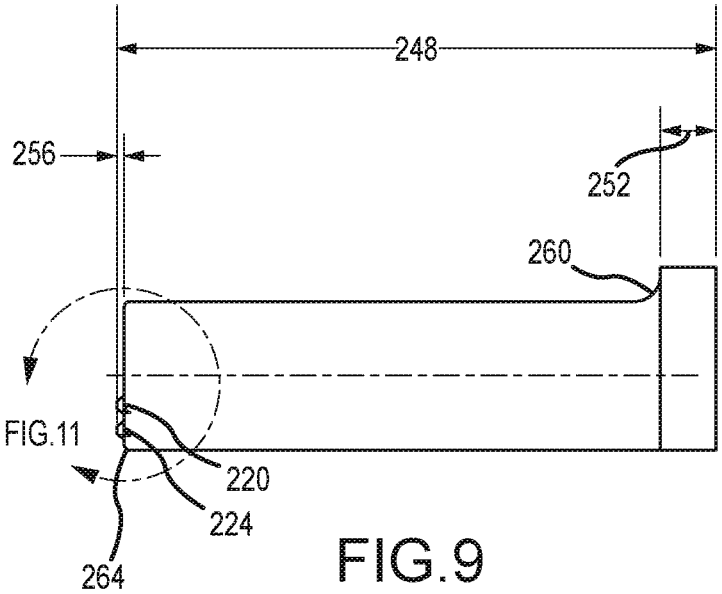
FIG. 9 is a side elevation view of the insert tool of FIG. 7.

FIG. 9 shows a side elevation view of the insert tool 200. The insert tool 200 has an overall length 248 measured from the top of the flange 216 down to the working edge of the shaped features 220, 224. In this embodiment, the overall length 248 is approximately 0.688 inches. The flange 216 also has a length 252 in FIG. 9, which is between approximately 0.065 and 0.063 inches. Finally, the shaped features 220, 224 have a length 256 measured from the end of the tool body 204 to the tip of the shaped features 220, 224. The shaped feature length 256 is between approximately 0.0095 and 0.0085 inches.

Also shown in FIG. 9 are two radiuses of the body 204 of the tool insert 200. The first radius 260 of the body 204 extends from the body 204 at the first end 208 and blends into the bottom surface of the flange 216. The first body radius 260 in this embodiment has a radius of curvature of approximately 0.03 inches. The second radius 264 of the body 204 is a radiused edge located at the second end 212 of the body 204. The second radius 264 in this embodiment has a radius of curvature of approximately 0.005 inches.

The surface of the flange 216 in this embodiment comprises a burrless etch to remove any leftover burrs from previous manufacturing. In other embodiments of the present invention, the flange 216 does not comprise a burrless etch. In further embodiments, other components of the insert tool 200 may also comprise a burrless etch. One skilled in the art will appreciate which components to apply a burrless etch to in order to enhance the performance of the present invention.

Figure 10:
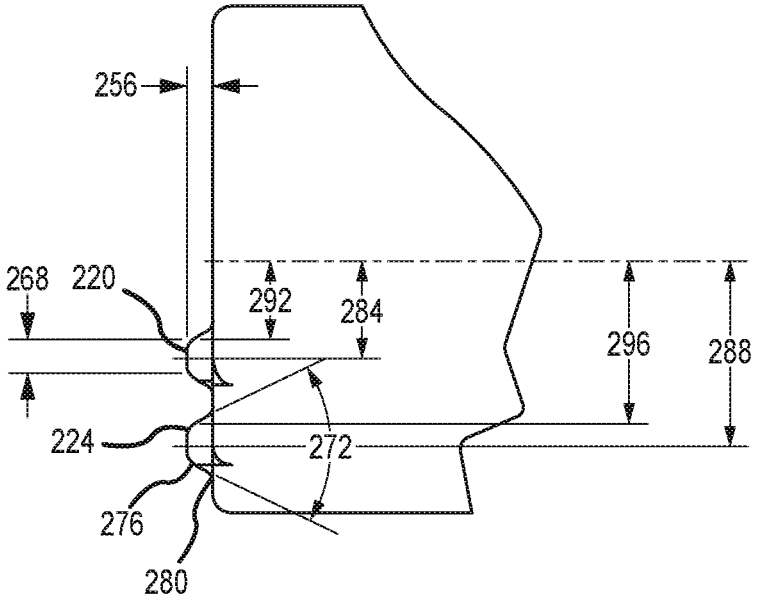
FIG. 10 is an enlarged side elevation view showing shaped features of the insert tool of FIG. 7.

FIG. 10 shows an enlarged detailed view of the second end 212 of the tool insert 200. The detailed view is at a scale of approximately 20:1. FIG. 10 shows the size of the shaped features 220, 224. As shown in FIG. 9, the shaped feature length 256 is between approximately 0.0095 and 0.0085 inches. The shaped features 220, 224 are flat at the end of the shaped feature length 256, and this flat surface may be defined as a shaped feature height 268. In this embodiment, the shaped feature height 268 is between approximately 0.0125 and 0.0115 inches, with a position tolerance of approximately 0.0005 inches.

The shaped features 220, 224 taper from the flat surface to the second end 212 of the body 204 at an angle 272, which is measured between the edge that tapers from the above the shaped features 220, 224 and the edge that tapers from below the shaped features 220, 224. The angle 272 in this embodiment is approximately 50 degrees. Further, there is a first transition 276 between the flat surface and the two edges that taper away from the flat surface. In this embodiment, the first transition 276 is a radiused edge that has a radius of curvature between approximately 0.003 and 0.001 inches. There is also a second transition 280 between the two edges that taper away from the flat surface and the second end 212 of the body 204. In this embodiment, the second transition 280 is a radiused edge that has a radius of curvature between approximately 0.003 and 0.001 inches.

FIG. 10 also shows the positions of the shaped features 220, 224 expressed in terms of offset from a horizontal plane through the center of the body 204. The first shaped feature 220 has a first centerline dimension 284 between the centerline of the first shaped feature 220 and the horizontal plane. In this embodiment, the first centerline dimension 284 is approximately 0.033 inches. Likewise, the second shaped feature 224 has a second centerline dimension 288 between the centerline of the second shaped feature 224 and the horizontal plane. In this embodiment, the second centerline dimension 288 is approximately 0.062 inches.

The positions of the shaped features 220, 224 may also be expressed in terms of the first transitions 276. The distance between the uppermost first transition 276 of the first shaped feature 220 and the horizontal plane may be identified as the first transition distance 292, which is 0.0264 inches in this embodiment. Similarly, the distance between the uppermost first transition 276 of the second shaped feature 224 and the horizontal plane may be identified as the second transition distance 296, which is approximately 0.0554 inches in this embodiment. As mentioned above, the dimensions of the shaped features 220, 224, and the spatial relationship among shaped features 220, 224 can vary to produce any of the anti-missile features described herein.

The material of the insert tool 200 in this embodiment is CPM REX M4 tool steel that has been hardened and grinded. The finish of the tool insert 200 is a titanium nitride coating that is 2 microns thick, or 0.00008 inches. When coating the tool insert 200, the temperature must not exceed 800 degrees Fahrenheit. One skilled in the art will appreciate that not all components of the insert tool 200—or any—necessarily have to be the above tool steel or titanium nitride coating. Different combinations of materials and coatings will provide different attributes to the insert tool 200 that one skilled in the art may find advantageous.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together. Further, the term "anti-missile features" as used herein may also refer to a single anti-missile feature or at least one anti-missile feature.

Unless otherwise indicated, all numbers expressing quantities, dimensions, conditions, and so forth used in the specification, drawings, and claims are to be understood as being modified in all instances by the term "about" or "approximately".

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

What is claimed is:

1. A method of forming a metallic end closure with an anti-missile feature, comprising:

providing a blank metallic material;

forming an end closure comprising a peripheral curl, a central panel, and a countersink positioned therebetween;

forming a first score line on said central panel, wherein said first score line substantially defines a tear panel;

providing a tool with at least one shaped feature disposed on a distal end of said tool;

pressing said tool into at least one of said central panel and said tear panel such that said at least one shaped feature contacts said at least one of said central panel and said tear panel at a location proximate said first score line to form a first anti-missile feature positioned proximate a second anti-missile feature in said end closure, wherein said first and second anti-missile features have a shallower depth than said first score line, and wherein said first anti-missile feature and said second anti-missile feature are disposed on said tear panel and oriented substantially parallel to each other; and interconnecting a pull tab to said central panel of said end closure, wherein a nose of said pull tab is positioned over said tear panel to facilitate opening of said end closure when a downward force is applied to said tear panel with said nose of said pull tab.

2. The method of claim 1, further comprising:

forming a second score line substantially parallel to said first score line, wherein said second score line has a shallower depth than said first score line.

3. The method of claim 2, wherein said first and second anti-missile features are disposed over said second score line.

4. The method of claim 1, wherein said first and second anti-missile features have longitudinal axes which are oriented at an acute angle relative to said first score line.

5. The method of claim 4, wherein said angle is between approximately 15 and 60 degrees.

6. The method of claim 1, wherein said first and second anti-missile features have a shape of at least one of a rectangle, a circle, an ovoid, a polygonal, a trapezium, and an arc shape.

7. A method of forming a metallic end closure with an anti-missile feature, comprising:

providing a blank metallic material;

forming an end closure comprising a peripheral curl, a central panel, and a countersink positioned therebetween;

forming a first score line on said central panel, wherein said first score line substantially defines a tear panel, and said first score line comprises a check slot having a first end and a second end;

providing a tool with at least one shaped feature disposed on a distal end of said tool;

pressing said tool into at least one of said central panel and said tear panel such that said at least one shaped feature contacts said at least one of said central panel and said tear panel at a location proximate to said first score line to form a first anti-missile feature positioned proximate a second anti-missile feature in said end closure, and wherein an end of said first anti-missile feature is positioned proximate to said check slot between said ends of said check slot, and an end of said second anti-missile feature is positioned proximate to said check slot between said ends of said check slot; and interconnecting a pull tab to said central panel of said end closure, wherein a nose of said pull tab is positioned over said tear panel to facilitate opening of said end closure when a downward force is applied to said tear panel with said nose of said pull tab.

8. The method of claim 7, further comprising:

forming a second score line substantially parallel to said first score line, wherein said second score line has a shallower depth than said first score line.

9. The method of claim 8, wherein said first and second anti-missile features are disposed over said second score line.

10. The method of claim 7, wherein said first and second anti-missile features have longitudinal axes which are oriented at an acute angle relative to said first score line.

11. The method of claim 10, wherein said angle is between approximately 15 and 60 degrees.

12. The method of claim 7, wherein said first and second anti-missile features have a shape of at least one of a rectangle, a circle, an ovoid, a polygonal, a trapezium, and an arc shape.

13. The method of claim 7, wherein said first and second anti-missile features are disposed on the tear panel side of said first score line.

14. The method of claim 7, wherein said first and second anti-missile features have a shallower depth than said first score line.

15. A method of forming a metallic end closure with anti-missile features, comprising:

providing a blank metallic material;

forming an end closure comprising a peripheral curl, a central panel, and a countersink positioned therebetween;

forming a first score line on said central panel, wherein said first score line substantially defines a tear panel;

providing a tool with a first shaped feature and a second shaped feature disposed on a distal end of said tool, wherein an end of said first shaped feature is offset from an end of said second shaped feature by a first offset distance, and a longitudinal axis of said first shaped feature is offset from a longitudinal axis of said second shaped feature by a second offset distance;

pressing said tool into at least one of said central panel and said tear panel such that said first shaped feature forms a first anti-missile feature and said second shaped feature forms a second anti-missile feature in said end closure; and interconnecting a pull tab to said central panel of said end closure, wherein a nose of said pull tab is positioned over said tear panel to facilitate opening of said end closure when a downward force is applied to said tear panel with said nose of said pull tab.

16. The method of claim 15, wherein said first offset distance is between approximately 0.026 and 0.022 inches.

17. The method of claim 15, wherein said second offset distance is approximately 0.029 inches.

18. The method of claim 15, wherein a direction of said second offset distance is substantially perpendicular to a direction of said first offset distance.

19. The method of claim 15, wherein said first and second anti-missile features have a shallower depth than said first score line.

20. The method of claim 15, wherein said first and second anti-missile features are disposed on the tear panel side of said first score line.

* * * * *